US009822780B2

(12) United States Patent
Calhoun

(10) Patent No.: US 9,822,780 B2
(45) Date of Patent: Nov. 21, 2017

(54) SCROLL VACUUM PUMP AND METHOD OF MAINTENANCE INCLUDING REPLACING A TIP SEAL OF A SCROLL VACUUM PUMP

(71) Applicant: AGILENT TECHNOLOGIES, INC., Santa Clara, CA (US)

(72) Inventor: John Calhoun, Lexington, MA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 15/074,635

(22) Filed: Mar. 18, 2016

(65) Prior Publication Data

US 2016/0201674 A1 Jul. 14, 2016

Related U.S. Application Data

(62) Division of application No. 13/873,793, filed on Apr. 30, 2013, now Pat. No. 9,341,186.

(51) Int. Cl.

| | |
|---|---|
| ***F04C 28/28*** | (2006.01) |
| ***F04C 29/00*** | (2006.01) |
| ***F04C 18/02*** | (2006.01) |
| ***F04C 27/00*** | (2006.01) |

(52) U.S. Cl.

CPC ..... *F04C 28/28* (2013.01); *F04C 18/0207* (2013.01); *F04C 18/0215* (2013.01); *F04C 18/0284* (2013.01); *F04C 29/0057* (2013.01); *F04C 27/005* (2013.01); *F04C 2220/50* (2013.01); *F04C 2230/80* (2013.01); *F04C 2230/85* (2013.01); *F04C 2240/81* (2013.01); *F04C 2270/80* (2013.01); *F04C 2270/86* (2013.01)

(58) Field of Classification Search

CPC .. F04C 28/28; F04C 29/0057; F04C 18/0284; F04C 18/0215; F04C 18/0207; F04C 2270/80; F04C 2220/50; F04C 2270/86; F04C 2230/80; F04C 2230/85; F04C 27/005; F04C 2240/81

USPC ..... 73/1.71, 1.57, 37, 40.5, 40, 46–47, 49.8

See application file for complete search history.

(56) References Cited

U.S. PATENT DOCUMENTS

| | | | | |
|---|---|---|---|---|
| 4,735,084 | A | 4/1988 | Fruzzetti | |
| 5,490,769 | A | 2/1996 | Calhoun | |
| 5,743,719 | A | 4/1998 | Haga et al. | |
| 5,823,756 | A | 10/1998 | Kawazoe | |
| 2001/0001639 | A1 | 5/2001 | Shaffer | |
| 2008/0310966 | A1 * | 12/2008 | Iwano | F04C 28/06 417/12 |
| 2011/0076172 | A1 | 3/2011 | Calhoun et al. | |
| 2013/0025349 | A1 | 1/2013 | Solomon et al. | |
| 2013/0259707 | A1 * | 10/2013 | Yin | F04B 49/00 417/53 |

* cited by examiner

*Primary Examiner* — Daniel S Larkin
*Assistant Examiner* — Anthony W Megna Fuentes

(57) ABSTRACT

A scroll pump has a tip seal between an axial end of the scroll blade of one of stationary and orbiting plate scrolls of the pump and the plate of the other of the stationary plate and orbiting plate scrolls. The scroll pump may have a ballast gas supply system and use the operation of the ballast gas supply system to assess the condition of the tip seal. Alternatively, the scroll pump may have two pressure sensors that sense pressure at two locations spaced along a compression mechanism of the pump to assess the condition of the tip seal.

9 Claims, 10 Drawing Sheets

SCROLL VACUUM PUMP AND METHOD OF MAINTENANCE INCLUDING REPLACING A TIP SEAL OF A SCROLL VACUUM PUMP

RELATED APPLICATIONS

This application is a divisional of and claims priority from U.S. patent application Ser. No. 13/873,793, filed Apr. 30, 2013, which is incorporated herein by reference in its entirety.

BACKGROUND OF THE INVENTION

1. Field of the Invention

The present invention relates to a scroll pump that includes plate scrolls having nested scroll blades, and tip seals that respectively provide a seal between the tip of the scroll blade of one of the plate scrolls and the plate of the other plate scroll. The present invention also relates to a method of maintaining a scroll vacuum pump including assessing the pump to determine whether a tip seal of the pump should be replaced.

2. Description of the Related Art

A scroll pump is a type of pump that includes a stationary plate scroll having a spiral stationary scroll blade, and an orbiting plate scroll having a spiral orbiting scroll blade. The stationary and orbiting scroll blades are nested with a clearance and predetermined relative angular positioning.

The orbiting scroll plate and hence, the orbiting scroll blade, is coupled to and driven by an eccentric driving mechanism so as to orbit about a longitudinal axis of the pump passing through the axial center of the stationary scroll blade. As a result of this orbiting motion, a series of pockets is delimited by and between the scroll blades. The orbiting motion of the orbiting scroll blade also causes the pockets to in effect move within the pump head assembly such that each of the pockets is selectively and sequentially placed in open communication with an inlet and outlet of the scroll pump, and the volumes of the pockets to vary as the pockets are moved.

More specifically, in an example of such a scroll pump, the motion of the orbiting scroll blade relative to the stationary scroll blade causes the volume of a pocket sealed off from the outlet of the pump and in open communication with the inlet of the pump to expand. Accordingly, fluid is drawn into the pocket through the inlet. Then the pocket is moved to a position at which it is sealed off from the inlet of the pump and is in open communication with the outlet of the pump, and during this time the volume of the pocket is reduced. Thus, the fluid in the pocket is compressed and thereby discharged through the outlet of the pump. In the case of a scroll vacuum pump, the inlet of the pump is connected to a system, e.g., a chamber, from which fluid is to be evacuated with the aid of the scroll pump.

Furthermore, each of the spiral scroll blades of a scroll pump has a number of turns or "wraps". The exact form of the spiral and the number of wraps dictate the number of pockets formed in series at any given time during the above-described compression process.

In this respect, the sidewall surfaces of the stationary orbiting scroll blades do not contact each other to maintain the pockets. Rather, minute clearances are maintained between the sidewall surfaces at the ends of each pocket after the pocket has been moved out of open communication with the inlet of the pump. Also, the tips of the spiral scroll blades and the opposing plates are spaced apart by minute axial clearances at the top and bottom of each pocket.

Oil may be used to create a seal between the stationary and orbiting plate scroll blades, i.e., to form seals that delimit the pockets with the scroll blades. On the other hand, certain types of scroll pumps, referred to as "dry" scroll pumps, avoid the use of oil because oil may contaminate the fluid being worked by the pump. Instead of oil, dry scroll pumps rely on the small radial clearances maintained between the sidewall surfaces of the nested scroll blades, and tip seals for sealing the top and bottom of each pocket.

With respect to tip seals, each tip seal is seated in a groove extending in and along the length of the tip (axial end) of a respective one of the scroll blades (the groove thus also having the form of a spiral) so as to be interposed between the tip of the scroll blade of a respective one of the plate scrolls and the plate of the other of the plate scrolls. Such tip seals wear out over time and thus, require periodic replacement.

Current practice to assess whether a tip seal needs to be replaced generally requires the user to shut down the process being carried out in the system to which the scroll vacuum pump is connected, disconnect the pump from the system, mount a vacuum pressure gauge to the pump, and run the pump until its ultimate pressure is established which may take at least one hour. In many cases, components of the pump have adsorbed process gas from the system and the pump is otherwise loaded with the process gas. In this case, the pump must be "degassed" and this degassing process adds significantly to the time it takes for ultimate pressure to be established. In any case, a value of the pressure of the fluid is read once ultimate pressure is established, and this value is compared with a reference value representative of the ideal ultimate pressure of the pump to determine the amount of internal leakage across the tip seals and hence, whether a tip seal might need replacing.

SUMMARY OF THE INVENTION

It is an object of the present invention to provide a scroll pump having means by which the condition of a tip seal(s) of the pump can be accurately assessed.

Likewise, it is an object of the present invention to provide a method by which the condition of a tip seal(s) of a scroll pump can be accurately assessed.

It is another object of the present invention to provide a scroll pump by which a technician or user can assess the condition of a tip seal(s) of the pump without the need to disconnect the pump from the system it is being used in connection with and/or without the need for carrying out a lengthy pump-down process.

It is likewise another object of the present invention to provide a method of operating a scroll pump that includes a process by which a tip seal(s) of the pump is assessed without disconnecting the pump from the system it is being used with and/or without performing a lengthy pump-down process.

According to a first aspect of the present invention, there is provided a scroll pump including an inlet portion having a pump inlet into which fluid is drawn by the pump, an exhaust portion including a pump outlet through which fluid is exhausted from the pump, a frame, a stationary plate scroll fixed to the frame, an orbiting plate scroll, a tip seal interposed between an axial end of the scroll blade of one of the stationary and orbiting plate scrolls and the plate of the other of the stationary plate and orbiting plate scrolls, an eccentric drive mechanism supported by the frame and to which the orbiting plate scroll is coupled so as to be driven by the eccentric drive mechanism in an orbit about a longitudinal axis of the pump, a ballast gas supply system, and control means that uses the operation of the ballast gas supply system to determine when the tip seal needs to be replaced.

The stationary scroll plate has a stationary plate and a stationary scroll blade in the form of a spiral including a plurality of successive wraps emanating from a central portion of the stationary plate, and the orbiting plate scroll has an orbiting plate and an orbiting scroll blade in the form of a spiral including a plurality of successive wraps emanating from a central portion of the orbiting plate. The stationary and orbiting scroll blades are nested, and the tip seal is interposed between an axial end of the scroll blade of one of the stationary and orbiting plate scrolls and the plate of the other of the stationary plate and orbiting plate scrolls.

During the orbital motion of the orbiting plate scroll relative to the stationary plate scroll, a series of pockets are simultaneously defined between the nested stationary and orbiting scroll blades, and the series of pockets constitute a compression mechanism of the pump. Also, each of the pockets is selectively and sequentially placed in open communication with the pump inlet and the pump outlet, and a compression process that occurs between a point in time at which the pocket is in open communication with the pump inlet and a later point in time at which the pocket is in open communication with the pump outlet.

The control means is configured to calculate a monitored pressure value based on both a pressure of the fluid sensed at a given location, along the direction of fluid flow, when the ballast gas supply system is disabled and a pressure of the fluid sensed at the same given location (e.g., the pump inlet) when the ballast gas supply system is enabled, to compare the monitored pressure value with a reference pressure value, and to output a signal when the monitored pressure value and the reference pressure value differ by at least a predetermined amount. The signal output by the control means is indicative that the tip seal requires replacement.

According to another aspect of the invention, there is provided a scroll pump including an inlet portion having a pump inlet into which fluid is drawn by the pump, an exhaust portion including a pump outlet through which fluid is exhausted from the pump, a frame, a stationary plate scroll fixed to the frame, an orbiting plate scroll, a tip seal interposed between an axial end of the scroll blade of one of the stationary and orbiting plate scrolls and the plate of the other of the stationary plate and orbiting plate scrolls, an eccentric drive mechanism supported by the frame and to which the orbiting plate scroll is coupled so as to be driven by the eccentric drive mechanism in an orbit about a longitudinal axis of the pump, pressure sensors that sense pressures of fluid at locations spaced along the direction of flow of fluid through the pump, respectively, and control means that uses the pressures sensed by the pressure sensors to determine when the tip seal needs to be replaced.

In this scroll pump as well, the stationary scroll plate has a stationary plate and a stationary scroll blade in the form of a spiral including a plurality of successive wraps emanating from a central portion of the stationary plate, and the orbiting plate scroll has an orbiting plate and an orbiting scroll blade in the form of a spiral including a plurality of successive wraps emanating from a central portion of the orbiting plate. The stationary and orbiting scroll blades are nested, and the tip seal is interposed between an axial end of the scroll blade of one of the stationary and orbiting plate scrolls and the plate of the other of the stationary plate and orbiting plate scrolls.

Also, during the orbital motion of the orbiting plate scroll relative to the stationary plate scroll, a series of pockets are simultaneously defined between the nested stationary and orbiting scroll blades, and the series of pockets constitute a compression mechanism of the pump. Also, each of the pockets is selectively and sequentially placed in open communication with the pump inlet and the pump outlet, and a compression process that occurs between a point in time at which the pocket is in open communication with the pump inlet and a later point in time at which the pocket is in open communication with the pump outlet.

The pressure sensors are operatively associated with the compression mechanism at first and second points, respectively, spaced along the direction of flow of fluid through the pump. Thus, the pressure sensors sense a first pressure of the fluid in the compression mechanism at a first location immediately upstream from one part of the compression mechanism and sense a second pressure of the fluid in the compression mechanism at a second location immediately downstream from the same part of the compression mechanism, respectively.

The control means is configured to calculate a monitored pressure value based on both the first and second sensed pressures, to compare the monitored pressure value with a reference pressure value, and to output a signal when the monitored pressure value and the reference pressure value differ by at least a predetermined amount. The signal output by the control means is indicative of a need to replace the tip seal.

According to yet another aspect of the present invention, there is provided a method of operating and maintaining a scroll vacuum pump, which includes running the scroll pump while the pump is connected to a system, at an inlet of the scroll pump, to discharge fluid from the system, sensing a first pressure proportional to a first fraction of the compression ratio of the pump and a second pressure proportional to a second fraction of the compression ratio of the pump both while the scroll pump is discharging fluid from the system, calculating a monitored pressure value based on both the first and second sensed pressures, comparing the monitored pressure value based on the first and second sensed pressures with a reference pressure value, and changing a tip seal of the scroll pump at a point in time after the monitored pressure value and the reference pressure value differ by at least a predetermined amount.

BRIEF DESCRIPTION OF THE DRAWINGS

These and other aspects, features and advantages of the present invention will become more clearly understood from the following detailed description of the preferred embodiments of the invention made with reference to the attached drawings, in which.

DETAILED DESCRIPTION OF THE PREFERRED EMBODIMENTS

Figure 1:
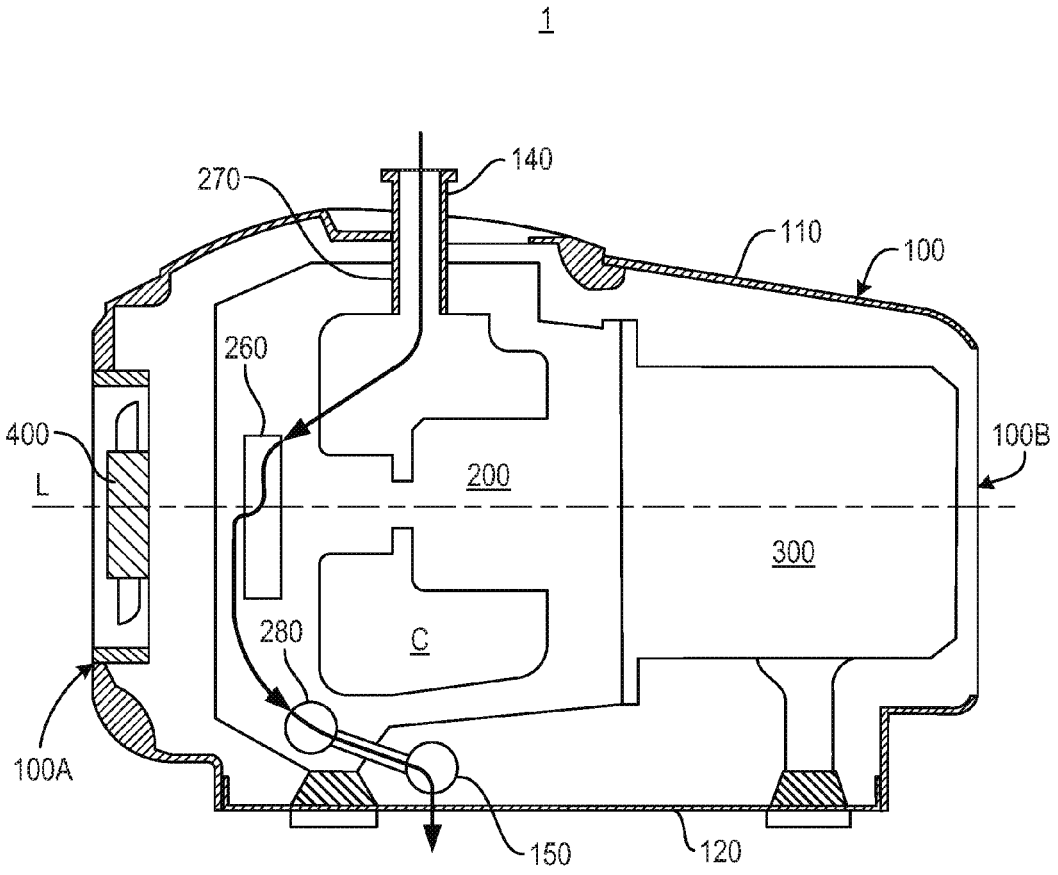
FIG. 1 is a schematic longitudinal sectional view of a scroll pump to which the present invention may be applied.

Various embodiments and examples of embodiments of the inventive concept will be described more fully hereinafter with reference to the accompanying drawings. In the drawings, the sizes and relative sizes of elements may be exaggerated for clarity. Likewise, the shapes of elements may be exaggerated and/or simplified for clarity and ease of understanding. Also, like numerals and reference characters are used to designate like elements throughout the drawings.

Furthermore, spatially relative terms, such as "front" and "back" are used to describe an element's relationship to another element(s) as illustrated in the figures. Thus, the spatially relative terms may apply to orientations in use which differ from the orientation depicted in the figures. Obviously, though, all such spatially relative terms refer to the orientation shown in the drawings for ease of description and are not necessarily limiting as apparatus according to the invention can assume orientations different than those illustrated in the drawings when in use.

Also, terminology used herein for the purpose of describing particular examples or embodiments of the inventive concept is to be taken in context. For example, the terms "comprises" or "comprising" when used in this specification indicates the presence of stated features or operations but does not preclude the presence of additional features or operations. The term "fixed" may be used to describe a direct connection of two parts to one another in such a way that the parts cannot move relative to one another or a connection of the parts through the intermediary of one or more additional parts in such a way that the parts cannot move relative to each other. Also, unless otherwise stated, the term "fixed" may describe a relationship between two unitary or integral parts of the pump and in the case of integral parts, does not preclude the possibility of one of the parts being detachable from the other. Finally, the term "spiral" as used to described a scroll blade is used in its most general sense and may refer to any of the various forms of scroll blades known in the art as having a number of turns or "wraps".

Referring now to FIG. 1, a scroll vacuum pump 1 to which the present invention can be applied generally includes a housing 100, and a pump head assembly 200, a pump motor 300, and a cooling fan 400 disposed in the housing 100. Furthermore, the housing 100 defines an air inlet 100A and an air outlet 100B at opposite ends thereof, respectively. The housing 100 may also include a cover 110 that covers the pump head assembly 200 and pump motor 300, and a base 120 that supports the pump head assembly 200 and pump motor 300. The cover 110 may be of one or more parts and is detachably connected to the base 120 such that the cover 110 can be removed from the base 120 to access the pump head assembly 200.

Referring to FIGS. 2-4C, the pump head assembly 200 includes a frame 210, a stationary plate scroll 220, an orbiting plate scroll 230, and an eccentric drive mechanism 240.

The frame 210 may be one unitary piece, or the frame 210 may comprise several integral parts that are fixed to one another.

Figure 3A:
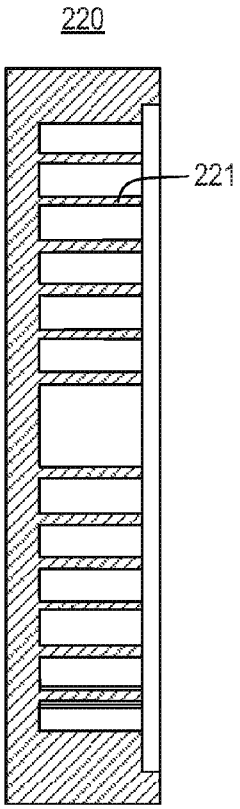
FIG. 3A is an enlarged sectional view of the stationary plate scroll of the scroll pump of FIGS. 1 and 2.
Figure 3B:
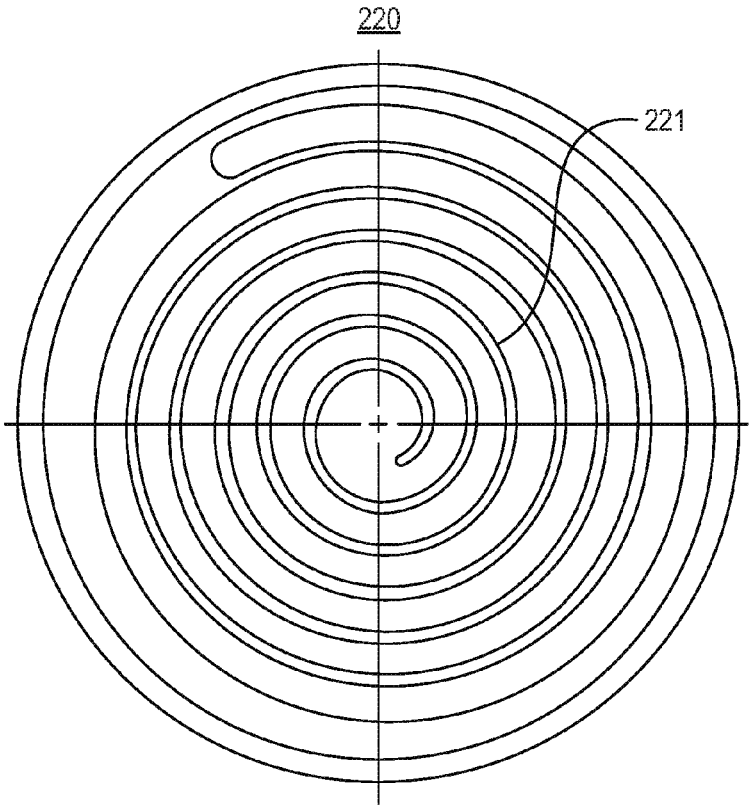
FIG. 3B is a front view of the stationary plate scroll.
Figure 4A:
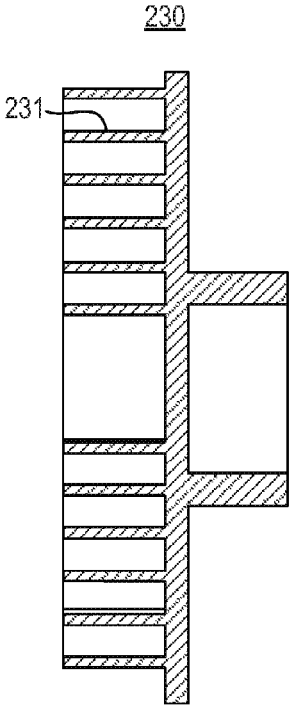
FIG. 4A is an enlarged sectional view of the orbiting plate scroll of the scroll pump of FIGS. 1 and 2.
Figure 4B:
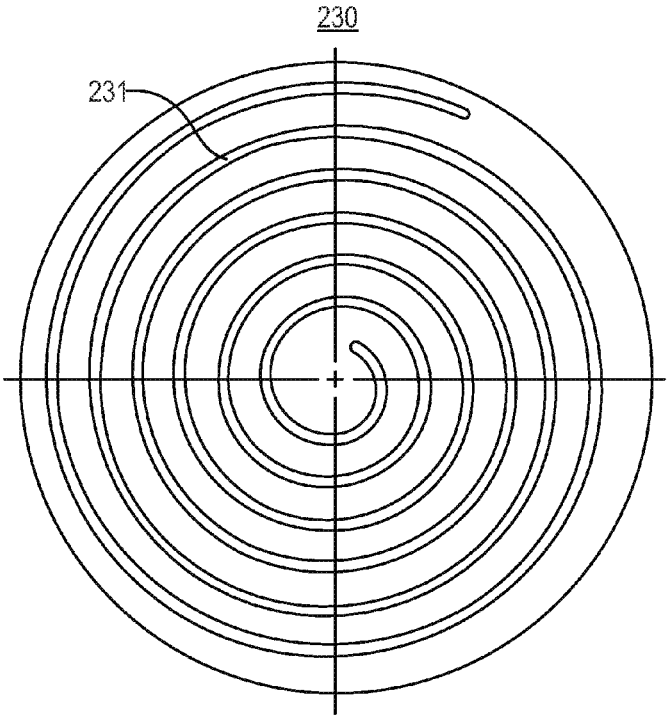
FIG. 4B is a front view of the orbiting plate scroll.

The stationary plate scroll 220 in this example is detachably mounted to the frame 210. The stationary plate scroll has a front side 220F and a back side 220B, and comprises a stationary scroll blade 221 at its front side 220F. Also, in this example, the stationary scroll blade 221 has six wraps configured as shown in FIGS. 3A and 3B. The orbiting plate scroll 230 has a front side 230F and a back side 230B, and comprises an orbiting scroll blade 231 at its front side 230F. The orbiting scroll blade 231 has wraps that are complementary to those of the stationary scroll blade 221 as shown in FIGS. 4A and 4B.

Figure 2:
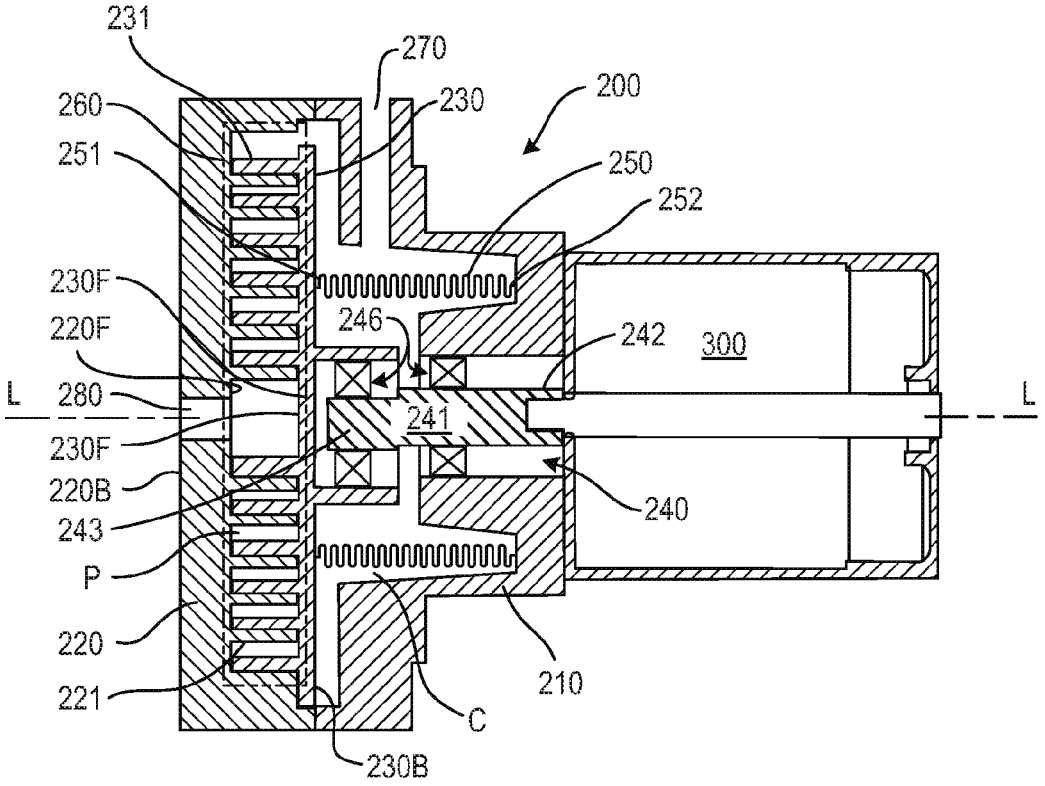
FIG. 2 is a schematic longitudinal sectional view of a pump head assembly of the scroll pump of FIG. 1.
Figure 4C:
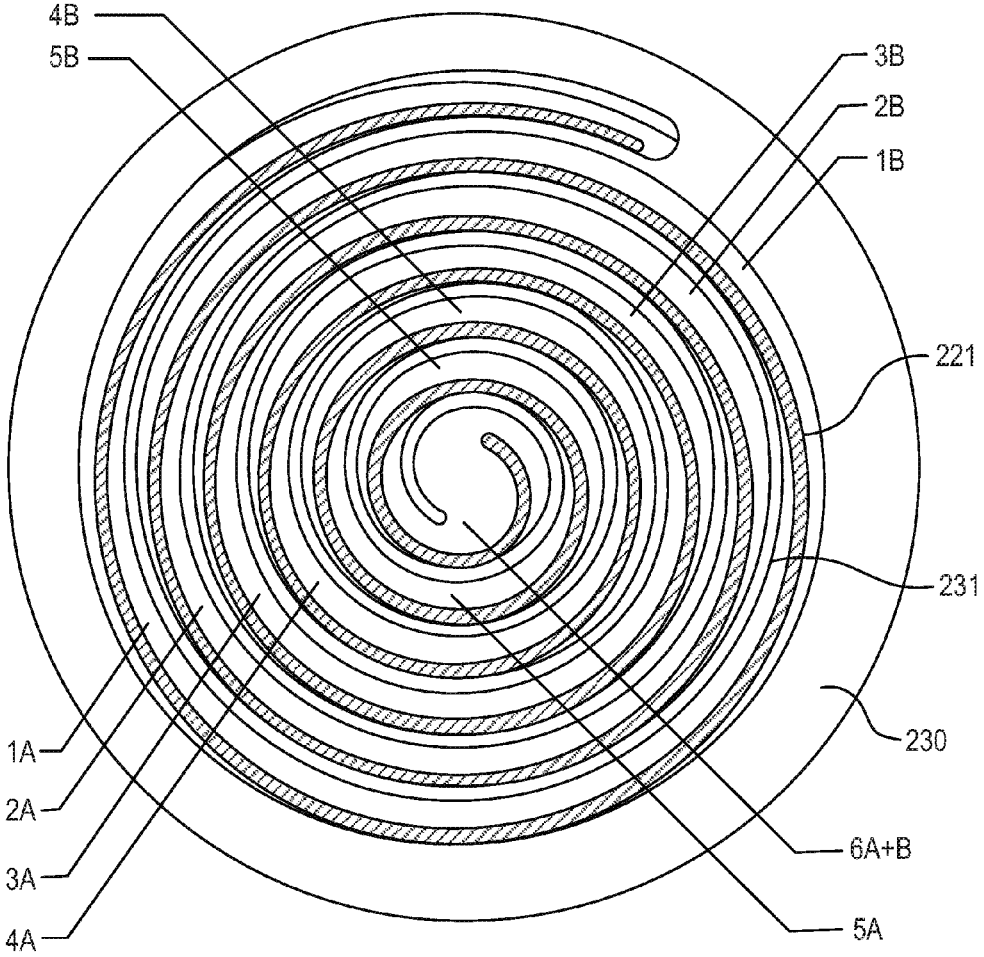
FIG. 4C is an assembly view of the stationary and orbiting plate scrolls of the scroll pump of FIGS. 1 and 2.

The stationary scroll blade 221 and the orbiting scroll blade 231 are nested, as shown in FIGS. 2 and 4C, with a clearance and predetermined relative angular positioning such that pockets (designated by reference numerals 1A, 1B, . . . 6A+B) are delimited by and between the stationary and orbiting scroll blades 221 and 231 during operation of the pump 1 to be described in detail below. In this respect, portions of the scroll blades 221 and 231 do not contact each other to seal the pockets. Rather, minute clearances between sidewall surfaces of the scroll blades 221 and 231 create seals sufficient for forming satisfactory pockets. Note, also, in FIG. 4C, the pockets A and B of each pair preceded by the same numeral are identical in size and function and can be treated considered as a single pocket or compression cell to be described later on. Thus, reference 6A+B in the figure designates a sixth pocket or cell formed by the joining of pockets 5A and 5B as the orbiting motion of the orbiting plate scroll 230 causes the pockets to move spirally inward toward the central axis L.

The eccentric drive mechanism 240 includes a drive shaft 241 and bearings 246. In this example, the drive shaft 241 is a crank shaft having a main portion 242 coupled to the motor 300 so as to be rotated by the motor 300 about a longitudinal axis L of the pump 1, and a crank 243 whose central longitudinal axis is offset in a radial direction from the longitudinal axis L. The bearings 246 comprise a plurality of sets of rolling elements.

Also, in this example, the main portion 242 of the crank shaft is supported by the frame 210 via one or more sets of the bearings 246 so as to be rotatable relative to the frame 210. The orbiting plate scroll 230 is mounted to the crank 243 via another set or sets of the bearings 246. Thus, the orbiting plate scroll 230 is carried by crank 243 so as to orbit about the longitudinal axis L of the pump 1 when the main shaft 242 is rotated by the motor 300, and the orbiting plate scroll 230 is supported by the crank 243 so as to be rotatable about the central longitudinal axis of the crank 243.

During a normal operation of the pump 1, a load applied to the orbiting scroll blade 231, due to the fluid being compressed in the pockets, tends to act in such a way as to cause the orbiting scroll plate 230 to rotate about the central longitudinal axis of the crank 243. However, a tubular member 250 and/or another mechanism such as an Oldham coupling restrains the orbiting plate scroll 230 in such a way as to allow it to orbit about the longitudinal axis L of the pump 1 while inhibiting its rotation about the central longitudinal axis of the crank 243.

In this example, the tubular member 250 is a metallic bellows. The metallic bellows is radially flexible enough to allow a first end 251 thereof to follow along with the orbiting plate scroll 230 while a second end 252 of the bellows remains fixed to the frame 210. On the other hand, the metallic bellows has a torsional stiffness that prevents the first end 251 of the bellows from rotating significantly about the central longitudinal axis of the bellows, i.e., from rotating significantly in its circumferential direction, while the second end 252 of the bellows remains fixed to the frame 210. Accordingly, the metallic bellows may be essentially the only means of providing the angular synchronization between the stationary scroll blades 221 and the orbiting scroll blades 231, respectively, during the operation of the pump 1.

The tubular member 250 also extends around a portion of the crank shaft and the bearings 246 of the eccentric drive mechanism 240. In this way, the tubular member 250 seals the bearings 246 and bearing surfaces from a space defined between the tubular member 250 and the frame 210 in the radial direction and which space may constitute the working chamber C, i.e., a vacuum chamber of the pump 1, through which fluid worked by the pump 1 passes. Accordingly, lubricant employed by the bearings 246 and/or particulate matter generated by the bearings surfaces can be prevented from passing into the chamber C by the tubular member 250.

Referring back to FIG. 1, the scroll vacuum pump 1 also has an inlet portion having a pump inlet 140 and constituting a vacuum side of the pump 1 where fluid is drawn into the pump 1, and an exhaust portion having a pump outlet 150 and constituting a compression side where fluid is discharged under pressure from the pump 1. The pump head assembly 200 also has an inlet opening 270 at the inlet side of the pump 1, and an exhaust opening 280 at the exhaust side of the pump 1. The inlet opening 270 connects the inlet 140 of the pump 1 to the vacuum chamber C. The outlet opening 280 leads to the pump outlet 150. Also, in FIG. 1, reference numeral 260 designates a compression mechanism (or stage) of the pump 1 which is constituted by the pockets 1A, 1B . . . 6A+B (FIG. 4C).

Figure 5:
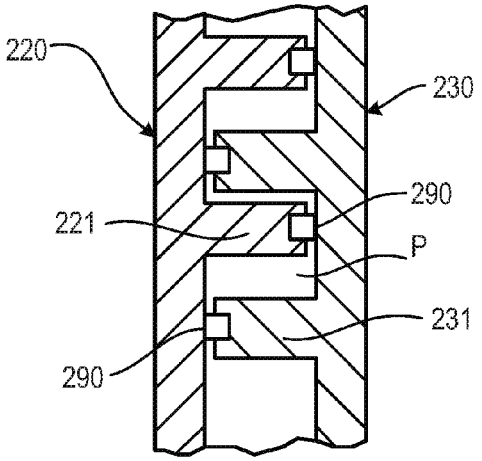
FIG. 5 is a sectional view of part of the pump head shown in FIG. 2, illustrating tip seals between the stationary plate scroll and the orbiting plate scroll.

Referring to FIG. 5, the pump head assembly 200 also has a tip seal 290 that creates an axial seal between the scroll blade of one of the orbiting and stationary plate scrolls and the (floor or plate) of the other of the orbiting and stationary plate scrolls. More specifically, the tip seal 290 is a plastic member seated in a groove in and running the length of the tip of the scroll blade 221, 231 of one of the stationary and orbiting plate scrolls 220, 230 so as to be interposed between the tip of the scroll blade 221, 231 and the plate of the other of the stationary and orbiting plate scrolls 220, 230. FIG. 5 shows tip seals 290 associated with both of the scroll blades 221, 231, respectively. Also, in FIG. 5 (and in FIG. 2), reference character P designates an arbitrary one of the above-mentioned pockets.

A scroll vacuum pump 1 having the structure described above operates as follows.

The orbiting motion of the orbiting scroll blade 231 relative to the stationary scroll blade 221 causes the volume of a lead pocket P sealed off from the outlet 150 of the pump 1 and in open communication with the inlet 140 of the pump 1 to expand. Accordingly, fluid is drawn into the lead pocket P through the pump inlet 140 via the inlet opening 270 of the pump head assembly 200 and the vacuum chamber C. The orbiting motion also in effect moves the pocket P to a position at which it is sealed off from the chamber C and hence, from the inlet 140 of the pump 1, and is in open communication with the pump outlet 150. Then the pocket P is in effect moved into open communication with the outlet opening 280 of the pump head assembly 280. During this time, the volume of the pocket P is reduced. Thus, the fluid in the pocket P is compressed and thereby discharged from the pump 1 through the outlet 150. Also, during this time (which corresponds to one orbit of the orbiting plate scroll 230), a number of successive or trailing pockets P may be formed between the stationary and orbiting scroll blades 221 and 231 and are in effect similarly and successively moved and have their volumes reduced. Thus, the compression mechanism 260 in this example is constituted by a series of pockets P. In any case, as shown schematically in FIG. 1 by the arrow-headed lines, the fluid is forced through the pump 1 due to the orbiting motion of the orbiting plate scroll 230 relative to the stationary plate scroll 220.

Furthermore, scroll vacuum pumps rely on the aforementioned small internal clearances between the sidewall surfaces of the spiral scroll blades, the tip seals at the tops of the scroll blades, and the numbers of wraps of the spiral scroll blades to generate the compression ratio required to meet the "ultimate pressure" requirements of the pumps. Thus, the ultimate pressure of a scroll vacuum pump is defined by the size of those leakages. More specifically, when the pump inlet is closed and no gas enters there, the ultimate pressure is the inlet pressure at which the (intended) pumping flow of fluid from the inlet to the outlet is equal to the (unintended) leakage of fluid in the reverse direction from the outlet toward the inlet.

Also, despite the use of small radial clearances between the sidewall surfaces, and the use of tip seals at the top and bottom, small leakages of the fluid being compressed still occur. Especially in the case in which the scroll pump is operating while meeting its "ultimate pressure" requirements, the inlet side of the scroll pump is at a low pressure, and the exhaust side of the pump is at a relatively high pressure (approximately atmospheric). The pressure differential from exhaust side to the inlet side creates a potential for leakage of the fluid in the pump in a direction from the exhaust side to the inlet side (sometimes referred to as back-streaming).

The internal leakages will now be described in more detail with reference to FIG. 6.

As is clear from the description above, a compression mechanism of a scroll vacuum pump can be modeled as a series of compression cells $C_n$, each cell $C_n$ with its own gross compression ratio and displacement.

Figure 6:
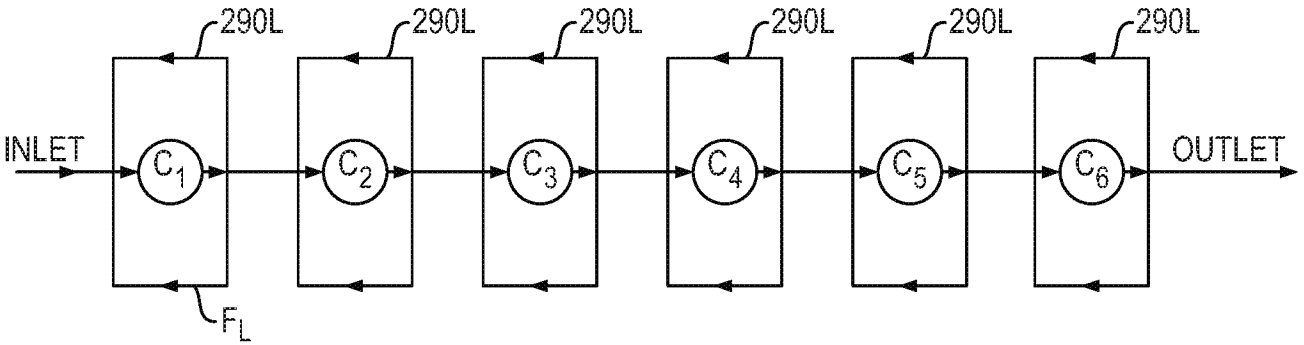
FIG. 6 is a conceptual diagram of a compression mechanism of a scroll vacuum pump during a compression process.

FIG. 6 shows an example in which the compression mechanism and compression process are modeled as six compression cells $C_1$-$C_6$ and in this case corresponding to the number of wraps of the scroll blades of the vacuum scroll pump 1. Such a pump would typically develop pressure at the pump inlet of 2 mTorr when there is no gas flow into the inlet and the ambient is at atmospheric pressure, i.e., when the pump is discharging fluid through the pump outlet into an environment at atmospheric pressure.

As is known in the art, leakage of the fluid from the exhaust side of the pump towards the inlet side of the pump occurs at both the trailing end of each pocket, as well as across the tip seal or seals that seal the pocket. As a result, a fraction of the fluid that would theoretically be displaced by each pocket P is lost. FIG. 6 schematically illustrates the leakages associated with the compression cells $C_1$, $C_2$ . . . $C_6$: leakages through the flank of a pocket designated by flow paths $F_L$, and the leakages associated with the tip seals delimiting the pocket P designated by flow paths $290_L$.

In addition, as the scroll vacuum pump is operated over the long term, the tip seals wear due to their being slid against the plate of the opposing plate scroll. Thus, over time, the tip seal leakages $290_L$ increase, eventually to the point that the effectiveness of the pump is severely reduced and/or the operation of a system connected to the pump is adversely impacted. These and other problems can be obviated by assessing the pump in time to determine if a tip seal requires replacement.

A first embodiment of a scroll vacuum pump and method of maintaining a scroll vacuum pump according to the present invention will now be described with respect to FIGS. 1-5, 7A and 7B.

Figure 7A:
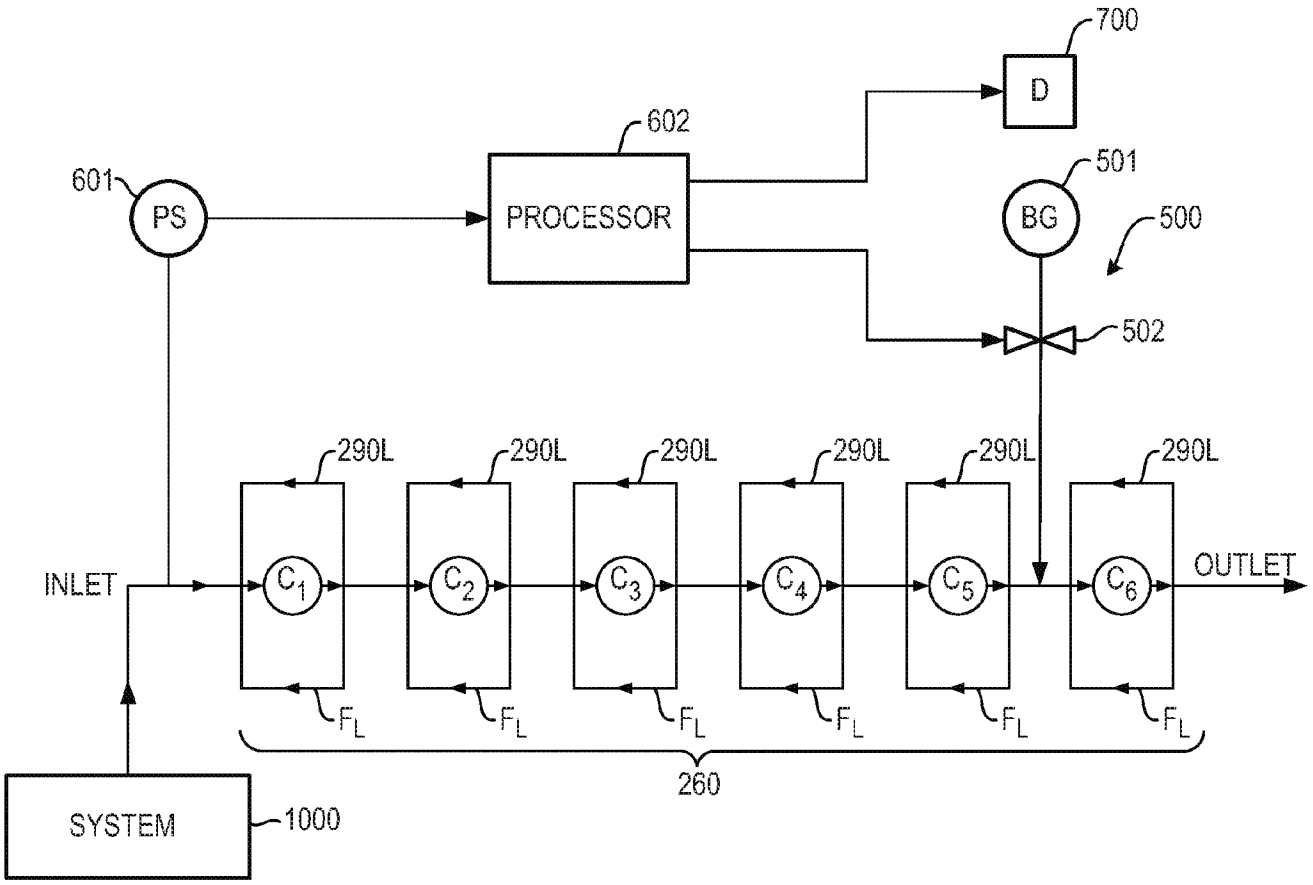
FIG. 7A is a block diagram of a system and an embodiment of a scroll vacuum pump according to the present invention.

In addition to the general components shown in and described with reference to FIGS. 1-5, an embodiment of a scroll vacuum pump according to the present invention also has, as shown in FIG. 7A, a ballast gas supply system 500 operative to supply a stream of ballast gas into the compression mechanism 260 of the pump at a location near a downstream end of the compression mechanism 260 with respect to the direction of flow of fluid through the pump, and control means including a pressure sensor 601 (vacuum pressure gauge) mounted to sense a pressure of the fluid flowing through the compression stage 260 and a controller 602 operatively connected to the pressure sensor 601. In one example of this embodiment, the pressure sensor 601 is mounted to the pump inlet 140 (FIG. 1) so as to sense a pressure of the fluid flowing through the inlet 140. The ballast gas supply system 500 includes a source of ballast supply gas 501 connected to the compression mechanism 260 of the pump, and at least one valve 502 disposed in-line between source of ballast supply gas 510 and the compression stage 260. The at least one valve 502 is movable between positions that enable the ballast gas supply system 500 (cause the ballast gas supply system 500 to supply ballast gas from source 501 into the compression stage 260) and disable the ballast gas supply system 500, respectively. The at least one valve 502 may be operatively connected to the controller 602 so as to be controlled by the controller 602. In this respect, the at least one valve 502 may be a solenoid or pneumatically operated valve or the like.

In any case, the ballast gas is introduced by the ballast gas supply system 500 into the compression mechanism 260, near the end of the compression process, to prevent condensable gas being worked by the pump from condensing inside the pump, as is known per se in the art. In this example, the ballast gas is supplied into the compression mechanism 260 at a point corresponding to a location between the last compression cell (sixth compression cell $C_6$) and the second-to-last compression cell (fifth compression cell $C_5$).

When the ballast gas is so supplied, the pressure of the fluid in the inlet 140 of the pump increases because the ballast gas has the effect of reducing the compression ratio CR of the pump. (The compression ratio of a scroll vacuum pump is the ratio between outlet and inlet pressures under a given operating condition. In this respect, the compression ratio is determined by the rate of transport of fluid (gas) from the inlet side of the pump to the outlet side of the pump, less any internal leakage that occurs, and is also a factor of the amount of volume reduction of the pockets from their size when fluid is taken in, versus their size when the fluid pockets reach communication with the pump outlet).

The present inventor has realized that the introducing of the ballast gas into the compression mechanism 260 in effect reduces the number of compression cells (from six to five in this example), and should increase the pressure at the pump inlet 140 by a factor equal to the compression ratio of that portion of the compression mechanism/process effectively eliminated when the ballast gas supply system is enabled. That is:

$$CR_{tot}=CR_1*CR_2*CR_3*CR_4*CR_5*CR_6 \quad (1)$$

$$CR_2=CR_1*CR_2*CR_3*CR_4*CR_5 \quad (2)$$

$$P_2=P_1*CR_6, \quad (3)$$

wherein $CR_{tot}$ is the compression ratio of the pump (in the state in which the ballast gas supply system 500 is disabled), $CR_2$ is the compression ratio of the pump in the state in which the ballast gas is being supplied, $CR_1$-$CR_6$ are the compression ratios attributable to the cells $C_1$-$C_6$, respectively, $P_1$ is the pressure sensed by pressure sensor 601 in the state in which the ballast gas supply system 500 is disabled, and $P_2$ is the pressure sensed by pressure sensor 601 in the state in which the ballast gas supply system 500 is enabled.

Figure 7B:
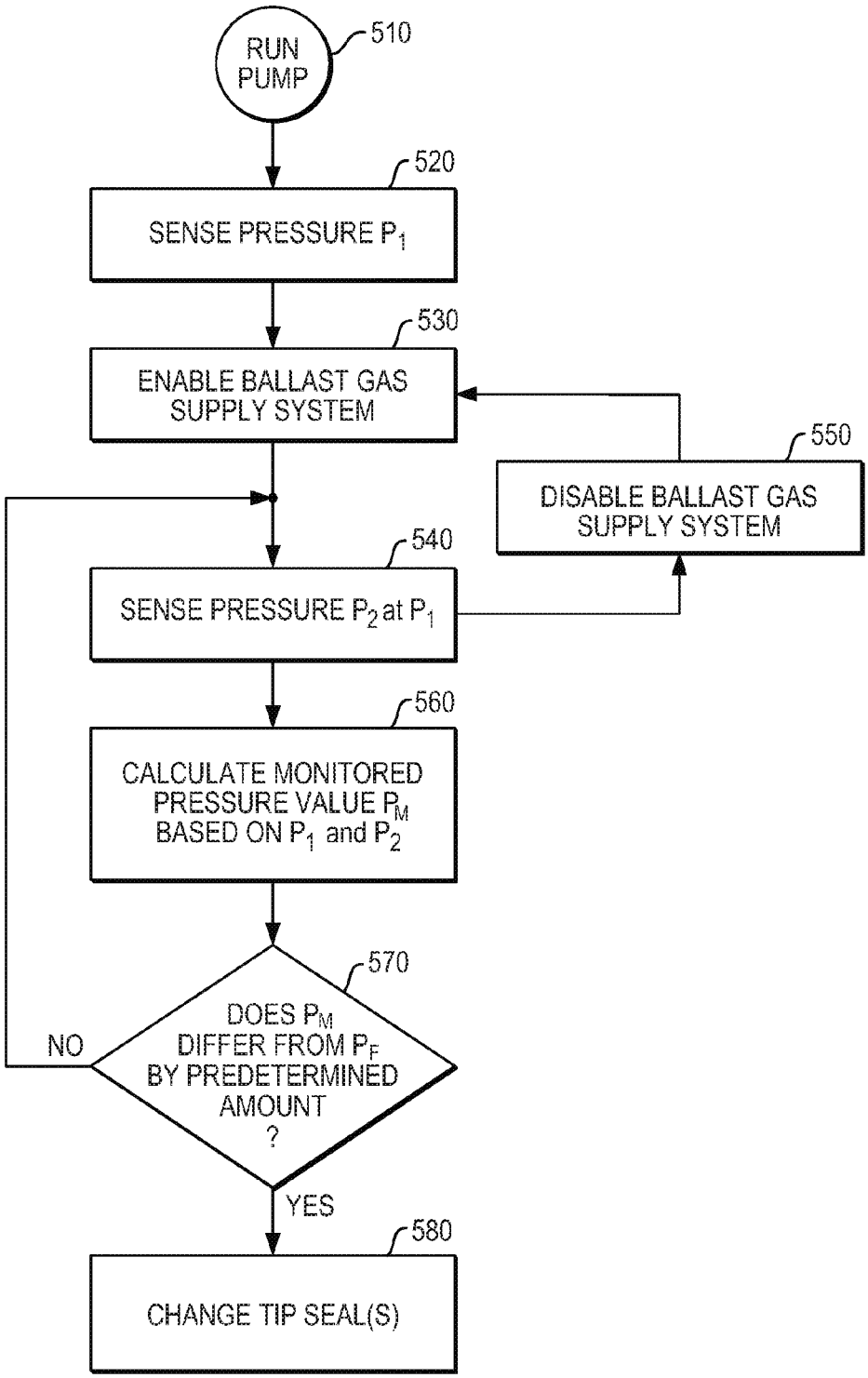
FIG. 7B is a flow chart of an embodiment of a method of operating the scroll vacuum pump of FIG. 7A, according to the present invention.

Referring now to FIGS. 7A and 7B, a method of operating the scroll vacuum pump starts by and is executed while running the scroll pump (step 510), i.e., while the pump is connected to a system 1000, at an inlet of the scroll pump, to discharge fluid from the system 1000. The fluid may be process gas and/or a by-product of a reaction of a process carried out in a chamber of the system 1000.

As the scroll vacuum pump is being run and the scroll pump is discharging gas from the system 1000, the pressure $P_1$ of the fluid at the inlet of the scroll pump is sensed (step 520) by pressure sensor 601, i.e., during a state in which no ballast gas is being supplied into the compression stage 260. A value of this pressure $P_1$ may be stored in a memory of the controller 602.

Also, as the scroll vacuum pump is being run, ballast gas is periodically supplied into the compression mechanism 260 of the scroll pump at a location adjacent a downstream end of the compression mechanism 260 with respect to the direction of gas flow through the pump (steps 530, 550) in a cycle designed to prevent a liquefying of the gas flowing through the pump. To this end, the controller 602 may periodically open the valve 502 to supply the ballast gas (step 530), and close the valve 502 (step 550) according to a program or feedback from the pump.

The pressure $P_2$ of the gas at the inlet of the scroll pump is also sensed by the pressure sensor 601 during the state in which ballast gas is being supplied into the compression mechanism 260 (step 540), and a value of the pressure $P_2$ is stored in the memory of the controller 602.

The controller 602 then calculates (step 560) a monitored pressure value $P_M$ based on both the first and second sensed pressures $P_1$ and $P_2$. For example, the monitored pressure value $P_M$ may be a ratio of $P_2$ to $P_1$ (i.e., $P_2/P_1$). Alternatively, the monitored pressure value $P_M$ may be the difference between $P_2$ and $P_1$. Then a comparator of the controller 602 compares (S70) the monitored pressure value $P_M$ with a reference pressure value $P_{Ref}$ also stored in the memory of the controller 602 or otherwise input to the controller 602. When the monitored pressure value $P_M$ and the reference pressure value $P_{Ref}$ differ by at least a predetermined amount, the controller may issue a signal to an audio or visual device 700 (e.g., an audio alarm or display screen) to warn a technician that a tip seal 290 requires replacement.

In this embodiment, therefore, the effect of introducing the ballast gas on the compression ratio of the pump is monitored, and this effect is used to provide an indication of excessive tip seal wear. That is, when the pressures $P_1$ and $P_2$ indicate that the compression ratio of the pump has degraded to a certain extent due to tip seal wear, a warning may be provided by the controller 602.

Then the tip seal(s) 290 is/are changed (step 580) at the next regularly scheduled maintenance when the pump is already disconnected from the system 1000. For example, with reference to FIGS. 1, 2 and 5, the cover 110 is removed to access the pump head assembly 200. Then the stationary plate scroll 220 is detached from the frame 210, thereby providing access to the tip seal(s) 290. The worn tip seal(s) 290 is removed from the groove in the tip of the blade in which it is seated and a new tip seal is inserted in the groove. Then the parts are re-assembled.

Another embodiment of a scroll vacuum pump and method of maintaining a scroll vacuum pump according to the present invention will now be described with respect to FIGS. 1-5, 8A and 8B.

Figure 8A:
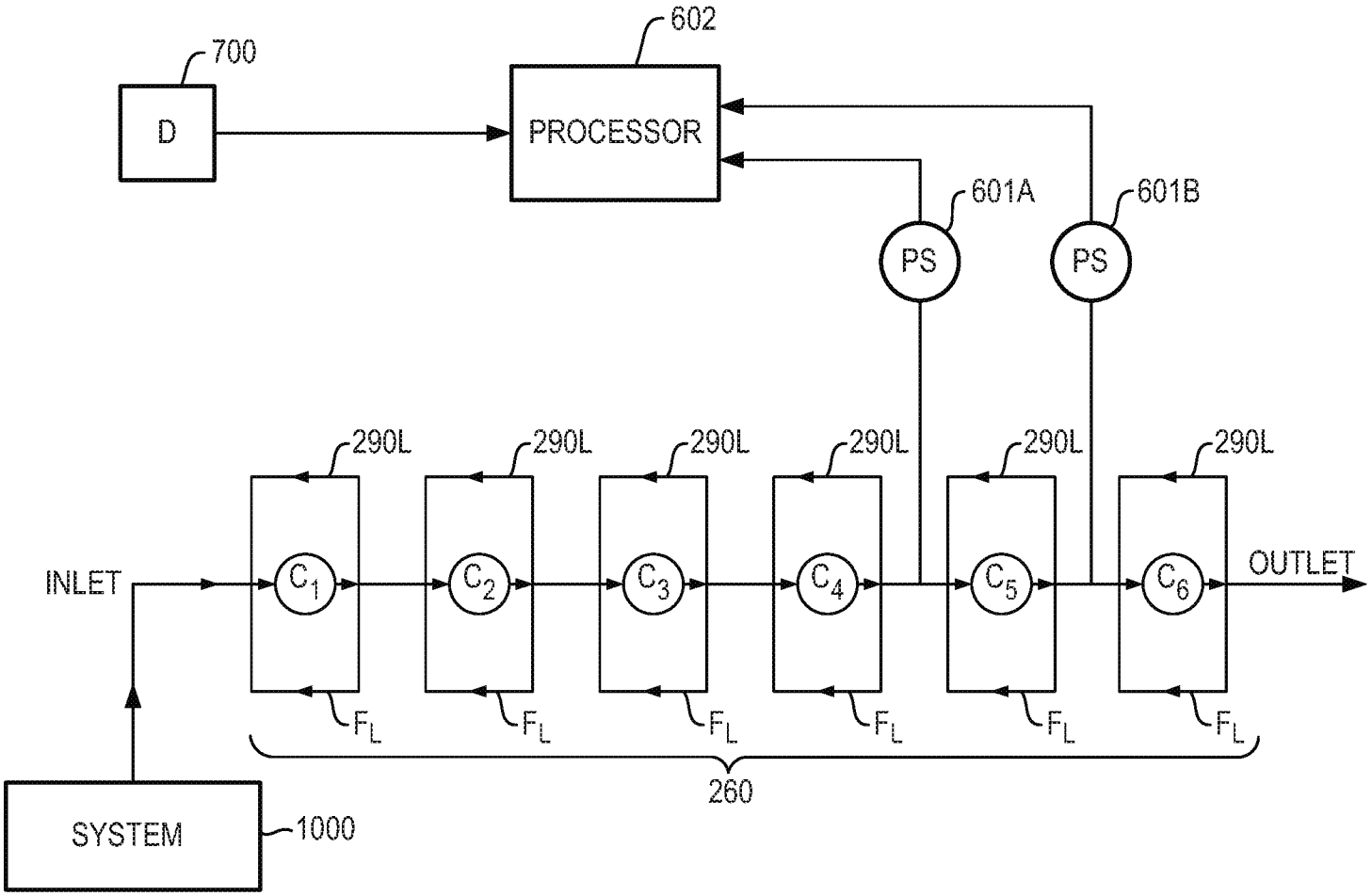
FIG. 8A is a block diagram of a system and another embodiment of a scroll vacuum pump according to the present invention.
Figure 8B:
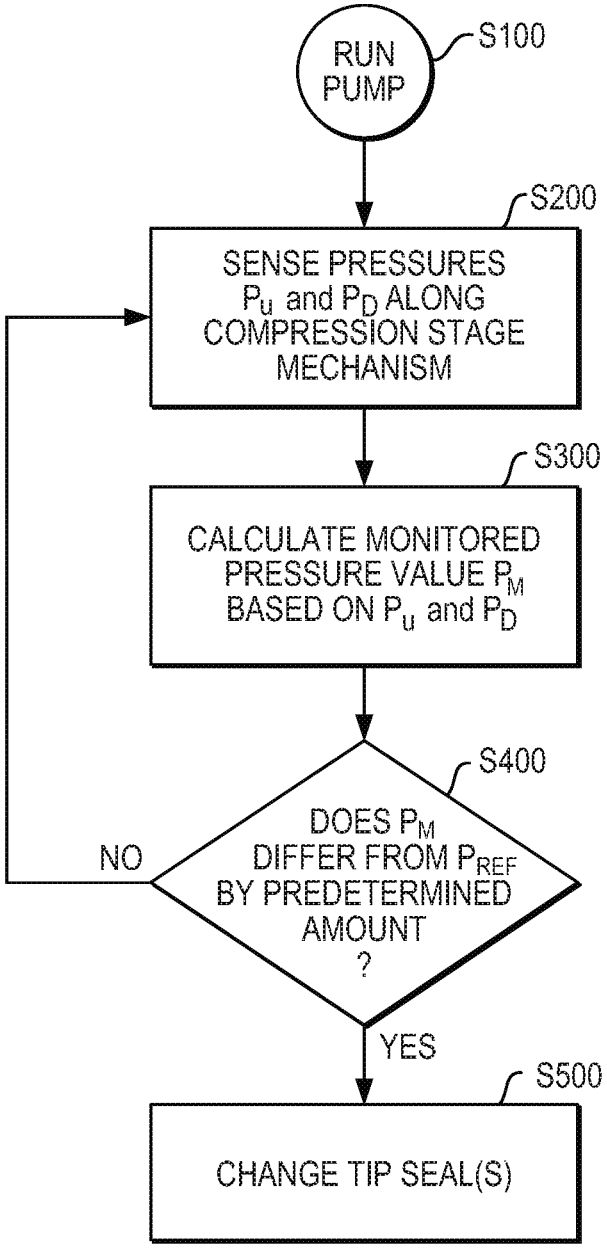
FIG. 8B is a flow chart of an embodiment of a method of operating the scroll vacuum pump of FIG. 8A, according to the present invention.

In addition to the general components shown in and described with reference to FIGS. 1-5, another embodiment of a scroll vacuum pump according to the present invention also has, as shown in FIG. 8A, first and second pressure sensors 601A and 601B (vacuum pressure gauges), and control means comprising a controller 602 operatively connected to the pressure sensors 601A and 601B. The pressure sensors 601A and 601B are operatively associated with the compression mechanism 260 at first and second points, respectively, spaced along the direction of flow of fluid through the pump. Thus, the pressure sensors 601A and 601B sense a first pressure of the fluid in the compression mechanism 260 at a first location immediately upstream from one part of the compression mechanism 260 (consisting of the fifth compression cell $C_5$ in this example) and sense a second pressure of the fluid in the compression mechanism 260 at a second location immediately downstream from that part (fifth compression cell $C_5$) of the compression mechanism 260, respectively.

Accordingly, in this embodiment:

$$P_D/P_U=CR_5, \tag{4}$$

wherein $P_D$ is the pressure of the fluid sensed by second pressure sensor 601B at a location /immediately downstream of cell $C_5$, $P_U$ is the pressure sensed by first pressure sensor 601A immediately upstream of cell $C_5$, and $CR_5$ is the compression ratio attributable to cell $C_5$.

In this embodiment, the pressure ratio $P_D/P_U$ or the differential pressure $P_{diff}=P_D-P_U$ across two points in the compression process is used to indicate the need to replace a tip seal(s) 290. In this respect, reference will now be made to FIGS. 8A and 8B.

A method of operating the scroll vacuum pump starts by and is executed while running the scroll pump (S100), i.e., while the pump is connected to a system 1000, at an inlet of the scroll pump, to discharge fluid from the system 1000. The fluid may be process gas and/or a by-product of a reaction of a process carried out in a chamber of the system 1000.

As the scroll vaccum pump is being run and the scroll pump is discharging gas from the system 1000, the pressures $P_D$ and $P_U$ are sensed (S200). That is, the pressure $P_U$ of fluid in the compression mechanism 260 of the pump at the first location immediately upstream of one portion (corresponding to cell $C_5$) of the compression mechanism 260 with respect to the direction of flow of fluid through the pump is sensed, and the pressure $P_D$ of fluid in the compression mechanism 260 of the pump at a second location immediately downstream of that portion (corresponding to cell $C_5$) of the compression mechanism 260 is sensed.

The controller 602 then calculates (S300) a monitored pressure value $P_M$ based on both the first and second sensed pressures $P_D$ and $P_U$. For example, the monitored pressure value $P_M$ may be a ratio of $P_D$ to $P_U$ (i.e., $P_D/P_U$). Alternatively, the monitored pressure value $P_M$ may be the difference between $P_D$ and $P_U$. Then a comparator of the controller 602 compares (S400) the monitored pressure value $P_M$ with a reference pressure value $P_{Ref}$ also stored in the memory of the controller 602 or otherwise input to the controller 602. When the monitored pressure value $P_M$ and the reference pressure value $P_{Ref}$ differ by at least a predetermined amount, the controller may issue a signal to an audio or visual device 700 (e.g., an audio alarm or display screen) to warn a technician that a tip seal 290 requires replacement.

Then the tip seal(s) 290 is/are changed (S500) at the next regularly scheduled maintenance when the pump is already disconnected from the system 1000.

As should be clear from the description above, according to an aspect of the present invention, the monitored pressure value $P_M$ is derived from two sensed pressures. Accordingly, the accuracy of the value $P_M$, i.e., the accuracy of the characterization of the tip seal wear, is dependent on the response slope(s) of the pressure gauge(s) used to measure the pressures in the pump, and not on the accuracy (calibration) of any one pressure gauge. Accordingly, the present invention can very accurately determine that state of the tip seal(s) at which replacement is required.

In addition, the effect of adsorbed or absorbed gas in the pump on the accuracy of the assessment is minimized, since the predetermined value $P_M$ can be determined based on the behavior of the pump in the actual application rather than relying on published values of ultimate pressure which are based on the absence of such conditions.

In addition, according to an aspect of the present invention, the assessment of the tip seal(s) can be made while the scroll pump is connected to a system and is operating under a steady state of gas flow from the system into the pump. Accordingly, the need to replace the tip seal(s) can be determined well in advance so that the tip seal replacement can be scheduled for the next regularly scheduled maintenance of the pump. Furthermore, it is not necessary to disconnect the pump from the system and perform time-consuming tests to determine whether the tip seal needs to be replaced. Thus, the present invention can decrease the downtime of various systems that require use of a scroll pump.

Finally, embodiments of the inventive concept and examples thereof have been described above in detail. The inventive concept may, however, be embodied in many different forms and should not be construed as being limited to the embodiments described above. Rather, these embodiments were described so that this disclosure is thorough and complete, and fully conveys the inventive concept to those skilled in the art. Thus, the true spirit and scope of the inventive concept is not limited by the embodiment and examples described above but by the following claims

What is claimed is:

1. A method of operating and maintaining a scroll vacuum pump, the method comprising:

running the scroll pump while the pump is connected to a system, at an inlet of the scroll pump, to discharge fluid from the system;

while the scroll pump is discharging fluid from the system, sensing a first pressure proportional to a first fraction of the compression ratio of the pump and a second pressure proportional to a second fraction of the compression ratio of the pump;

calculating a monitored pressure value based on both the first and second sensed pressures;

comparing the monitored pressure value based on the first and second sensed pressures with a reference pressure value; and changing a tip seal, interposed between an axial end of a scroll blade of one of stationary and orbiting plate scrolls and a plate of the other of the stationary plate and orbiting plate scrolls of the scroll pump, at a point in time after the monitored pressure value and the reference pressure value differ by at least a predetermined amount.

2. The method of claim 1, further comprising periodically supplying a ballast gas into a compression stage of the scroll pump at a downstream end of the compression stage with respect to the direction of fluid flow through the pump, while the scroll pump is being run to discharge fluid from the system, the compression stage constituted by a series of pockets of the scroll pump defined between stationary and orbiting scroll blades of the pump, and wherein the sensing of the first pressure comprises sensing the pressure of the fluid at a location along the direction of fluid flow during a state in which no ballast gas is being supplied into the compression stage, and the sensing of the second pressure comprises sensing the pressure of the fluid at said location during a state in which ballast gas is being supplied into the compression stage at said downstream end thereof.

3. The method of claim 2, wherein the calculating of the monitored pressure value comprises calculating a ratio of the first and second sensed pressures.

4. The method of claim 2, wherein the calculating of the monitored pressure value comprises calculating a difference between the first and second sensed pressures.

5. The method of claim 2, wherein the sensing of the first and second pressures each comprises sensing the pressure of the fluid at the inlet of the scroll pump.

6. The method of claim 1, wherein the sensing of the first pressure comprises sensing the pressure of fluid in the compression stage of the pump at a first location immediately upstream of one portion of the compression stage with respect to the direction of flow of fluid through the pump, and the sensing of the second pressure comprises sensing the pressure of fluid in the compression stage of the pump at a second location immediately downstream of said one portion of the compression stage with respect to the direction of flow of fluid through the pump.

7. The method of claim 6, wherein the calculating of the monitored pressure value comprises calculating a ratio of the first and second sensed pressures.

8. The method of claim 6, wherein the calculating of the monitored pressure value comprises calculating a difference between the first and second sensed pressures.

9. A scroll pump comprising:

an inlet portion having a pump inlet into which fluid is drawn by the pump, and an exhaust portion including a pump outlet through which fluid is exhausted from the pump;

a frame;

a stationary plate scroll fixed to the frame and including a stationary plate, and a stationary scroll blade projecting from the stationary plate;

an orbiting plate scroll including an orbiting plate, and an orbiting scroll blade projecting axially from the orbiting plate, the stationary scroll blade having the form of a spiral including a plurality of successive wraps emanating from a central portion of the stationary plate, the orbiting scroll blade having the form of a spiral including a plurality of successive wraps emanating from a central portion of the orbiting plate, and the stationary and orbiting scroll blades being nested;

a tip seal interposed between an axial end of the scroll blade of one of the stationary and orbiting plate scrolls and the plate of the other of the stationary plate and orbiting plate scrolls;

an eccentric drive mechanism supported by the frame, and the orbiting plate scroll being coupled to the eccentric drive mechanism so as to be driven by the eccentric drive mechanism in an orbit about the longitudinal axis of the pump, wherein during the orbital motion of the orbiting plate scroll relative to the stationary plate scroll, a series of pockets are simultaneously defined between the nested stationary and orbiting scroll blades, the series of pockets constitute a compression stage of the pump, each of the pockets is selectively and sequentially placed in open communication with the pump inlet and the pump outlet, and a compression process in which fluid trapped in the pocket is compressed occurs between a point in time at which the pocket is in open communication with the pump inlet and a later point in time at which the pocket is in open communication with the pump outlet;

pressure sensors operatively associated with the compression stage at first and second points, respectively, spaced along the direction of flow of fluid through the pump, wherein the pressure sensors sense a first pressure of the fluid in the compression stage at a first location immediately upstream from one part of the compression stage and sense a second pressure of the fluid in the compression stage at a second location immediately downstream from said one part of the compression stage, respectively; and control means configured to calculate a monitored pressure value based on both the first and second sensed pressures, to compare the monitored pressure value with a reference pressure value, and to output a signal, indicative of a need to replace the tip seal, when the monitored pressure value and the reference pressure value differ by at least a predetermined amount.

* * * * *